US011394099B2

(12) United States Patent
Bae et al.

(10) Patent No.: US 11,394,099 B2
(45) Date of Patent: Jul. 19, 2022

(54) CONNECTOR FOR CONNECTING A WAVEGUIDE TO A BOARD AND HAVING A FIRST OPENING PART FACING THE BOARD AND A SECOND OPENING PART FOR RECEIVING THE WAVEGUIDE

(71) Applicant: Korea Advanced Institute Of Science And Technology, Daejeon (KR)

(72) Inventors: Hyeon Min Bae, Daejeon (KR); Ha Il Song, Daejeon (KR)

(73) Assignee: Korea Advanced Institute Of Science And Technology, Daejeon (KR)

( * ) Notice: Subject to any disclaimer, the term of this patent is extended or adjusted under 35 U.S.C. 154(b) by 0 days.

(21) Appl. No.: 17/036,743

(22) Filed: Sep. 29, 2020

(65) Prior Publication Data

US 2021/0013577 A1 Jan. 14, 2021

Related U.S. Application Data

(63) Continuation of application No. PCT/KR2019/004105, filed on Apr. 5, 2019.

(30) Foreign Application Priority Data

Apr. 6, 2018 (KR) ..... 10-2018-0040496

(51) Int. Cl.

| | |
|---|---|
| ***H01P 5/08*** | (2006.01) |
| ***H01P 5/18*** | (2006.01) |
| ***H01P 1/04*** | (2006.01) |

(52) U.S. Cl.

CPC ..... *H01P 5/08* (2013.01); *H01P 1/042* (2013.01); *H01P 5/087* (2013.01); *H01P 5/182* (2013.01)

(58) Field of Classification Search

CPC ..... H01P 5/087; H01P 1/042

(Continued)

(56) References Cited

U.S. PATENT DOCUMENTS

2015/0372388 A1* 12/2015 Martineau et al. .... H01Q 13/06 343/785

2016/0320568 A1 11/2016 Haase et al.

(Continued)

FOREIGN PATENT DOCUMENTS

JP 2004040405 A 2/2004

JP 5395042 B2 1/2014

(Continued)

OTHER PUBLICATIONS

International Search Report of PCT/KR2019/004105 dated Jul. 18, 2019.

*Primary Examiner* — Benny T Lee

(74) *Attorney, Agent, or Firm* — Dinsmore & Shohl LLP; Yongsok Choi, Esq.

(57) ABSTRACT

According to one aspect of the invention, there is provided a connector for connecting a waveguide and a board, comprising: a first opening part formed in a direction perpendicular to one side of a board and coupled to the one side of the board; a second opening part formed in a direction parallel to a longitudinal direction of a waveguide for signal transmission, wherein the waveguide is capable of being coupled to the second opening part; and a signal guide part connecting the first and second opening parts and including a hollowness surrounded by a conductive layer therein.

6 Claims, 5 Drawing Sheets

(58) Field of Classification Search
USPC ..... 333/248, 254
See application file for complete search history.

(56) References Cited

U.S. PATENT DOCUMENTS

| | | | | |
|---|---|---|---|---|
| 2017/0093009 | A1 | 3/2017 | Herbsommer et al. | |
| 2017/0229753 | A1 | 8/2017 | Lee et al. | |
| 2017/0271738 | A1 | 9/2017 | Smith, Jr. et al. | |
| 2019/0013563 | A1* | 1/2019 | Takeda et al. ..... | H01P 5/022 |
| 2019/0097294 | A1* | 3/2019 | Rusch et al. ..... | H01P 5/087 |

FOREIGN PATENT DOCUMENTS

| | | | |
|---|---|---|---|
| JP | 5954934 | B2 | 7/2016 |
| JP | 2017192101 | A | 10/2017 |
| KR | 100811910 | B1 | 3/2008 |
| KR | 1020110039018 | A | 4/2011 |

* cited by examiner

CONNECTOR FOR CONNECTING A WAVEGUIDE TO A BOARD AND HAVING A FIRST OPENING PART FACING THE BOARD AND A SECOND OPENING PART FOR RECEIVING THE WAVEGUIDE

CROSS-REFERENCE TO RELATED APPLICATIONS

This application is a continuation application of Patent Cooperation Treaty (PCT) international application Serial No. PCT/KR2019/004105, filed on Apr. 5, 2019, which claims priority to Korean Patent Application Serial No. 10-2018-0040496, filed on Apr. 6, 2018. The entire contents of PCT international application Serial No. PCT/KR2019/004105 and Korean Patent Application Serial No. 10-2018-0040496 are hereby incorporated by reference.

FIELD OF THE INVENTION

The present invention relates to a connector for connecting a waveguide and a board.

BACKGROUND

As data traffic is rapidly increased, data transmission/receipt speed of input/output (I/O) bus connecting integrated circuits is also being quickly increased. For the last decades, conductor-based interconnects (e.g., copper wires) with high cost and power efficiencies have been widely applied to wired communication systems. However, such conductor-based interconnects have inherent limitations in channel bandwidths due to skin effect caused by electromagnetic induction.

Meanwhile, optic-based interconnects with high data transmission/reception speed have been introduced and widely used as an alternative to the conductor-based interconnects. However, the optic-based interconnects have limitations in that these interconnects cannot completely replace the conductor-based interconnects because the costs of installation and maintenance thereof are very high.

Recently, a new type of interconnect using the advantages of a waveguide has been introduced. A representative example thereof is an interconnect comprising a dielectric part in the form of a core and a metal part in the form of a thin cladding surrounding the dielectric part. Since such an interconnect (so-called "e-tube") has advantages of both of metal and dielectric, such an interconnect advantageously has high cost and power efficiencies and enables high-speed data communication within a short range. Thus, it has come into the spotlight as a next-generation interconnect employable in chip-to-chip or board-to-board communication.

However, when such an interconnect and a board are connected to each other, the interconnect has to be coupled in a direction perpendicular to one side of the board, due to electromagnetic wave characteristics, signal loss and the like. As a result, there is a problem that when a plurality of boards are connected to each other or such an interconnect is used in a server deck or the like whose space for accommodating the boards is small, the interconnect cannot be easily connected.

In this regard, the inventor(s) present a connector for connecting a waveguide (e.g., e-tube) and a board, wherein the connector may guide a signal provided in a direction perpendicular to one side of the board such that the signal is transmitted in a direction parallel to a longitudinal direction of the waveguide (or may guide a signal provided in the direction parallel to the longitudinal direction of the waveguide such that the signal is transmitted in the direction perpendicular to the one side of the board).

SUMMARY OF THE INVENTION

One object of the present invention is to solve all the above-described problems.

Another object of the invention is to provide a connector capable of guiding a signal in a desired direction between a board and a waveguide, while preventing the signal from leaking outwardly.

Yet another object of the invention is to employ an interconnect (e.g., e-tube) using the aforementioned advantages of a waveguide such that the interconnect may be connected in a direction parallel to one side of a board to improve freedom of connection and utilization of space.

The representative configurations of the invention to achieve the above objects are described below.

According to one aspect of the invention, there is provided a connector for connecting a waveguide and a board, comprising: a first opening part formed in a direction perpendicular to one side of a board and coupled to the one side of the board; a second opening part formed in a direction parallel to a longitudinal direction of a waveguide for signal transmission, wherein the waveguide is capable of being inserted in the second opening part; and a signal guide part connecting the first and second opening parts and including a hollow portion surrounded by a conductive layer therein.

According to the invention, it is possible to provide a connector capable of guiding a signal in a desired direction between a board and a waveguide, while preventing the signal from leaking outwardly.

According to the invention, it is possible to employ an interconnect (e.g., e-tube) using the aforementioned advantages of a waveguide such that the interconnect may be connected in a direction parallel to one side of a board to improve freedom of connection and utilization of space.

DETAILED DESCRIPTION OF THE INVENTION

Figure 1:
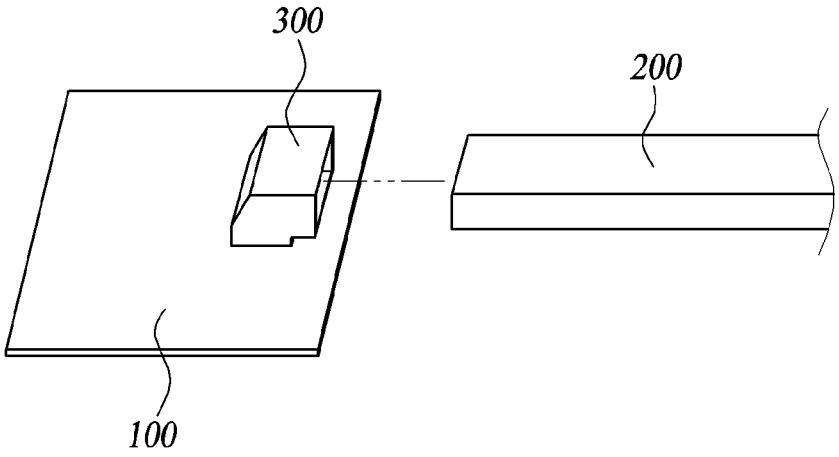
FIG. 1 illustratively shows an entire interface in which a board and a waveguide are connected according to one embodiment of the invention.

In the following detailed description of the present invention, references are made to the accompanying drawings that show, by way of illustration, specific embodiments in which the invention may be practiced. These embodiments are described in sufficient detail to enable those skilled in the art to practice the invention. It is to be understood that the various embodiments of the invention, although different from each other, are not necessarily mutually exclusive. For example, specific shapes, structures and characteristics described herein may be implemented as modified from one embodiment to another without departing from the spirit and scope of the invention. Furthermore, it shall be understood that the locations or arrangements of individual elements within each embodiment may also be modified without departing from the spirit and scope of the invention. Therefore, the following detailed description is not to be taken in a limiting sense, and the scope of the invention is to be taken as encompassing the scope of the appended claims and all equivalents thereof. In the drawings, like reference numerals refer to the same or similar elements throughout the several views.

Hereinafter, various preferred embodiments of the present invention will be described in detail with reference to the accompanying drawings to enable those skilled in the art to easily implement the invention.

Configuration of the Entire Interface

FIG. 1 illustratively shows the entire interface in which a board and a waveguide are connected according to one embodiment of the invention.

First, referring to FIG. 1, the entire interface according to one embodiment of the invention may comprise: a board 100; a waveguide 200, which is an interconnect means for transmission of electromagnetic wave signals (e.g., data communication) between the board 100 and another board (not shown); and a connector 300 coupled to the board 100 and the waveguide 200 and configured to guide a direction of transmission of the signals between the board 100 and the waveguide 200.

According to one embodiment of the invention, a signal transmitted from the board 100 may be transmitted to the connector 300 in a direction perpendicular to one side of the board 100, and the transmitted signal may be guided by the connector 300 such that the signal is transmitted in a direction parallel to a longitudinal direction of the waveguide 200. Further, according to one embodiment of the invention, the guided signal may be transmitted to the other board through the waveguide 200 coupled to the connector 300 in the direction parallel to the longitudinal direction of the waveguide 200. Furthermore, according to one embodiment of the invention, a signal transmitted from the other board may be transmitted to the connector 300 through the waveguide 200 in the direction parallel to the longitudinal direction of the waveguide 200, and the transmitted signal may be guided by the connector 300 such that it is transmitted in the direction perpendicular to the one side of the board 100. In addition, according to one embodiment of the invention, the guided signal may be transmitted to the board 100 coupled to the connector 300.

Meanwhile, according to one embodiment of the invention, the board 100 may comprise a patch for emitting a signal to the waveguide 200 or the connector 300.

For example, according to one embodiment of the invention, a signal generated from a chip present in the board 100 may be propagated along a microstrip circuit (not shown) of the board 100, and the propagated signal may be emitted to the connector 300 through the above described patch. It should be understood that the chips described herein do not only represent electronic circuit components in a traditional sense, each chip comprising a number of semiconductors (e.g., transistors) and the like, but also encompass, in their broadest sense, all types of components or elements that can exchange electromagnetic wave signals with each other.

Configuration of the Connector

Hereinafter, the internal configuration of the connector 300 crucial for implementing the invention and the functions of the respective components thereof will be discussed.

Figure 2:
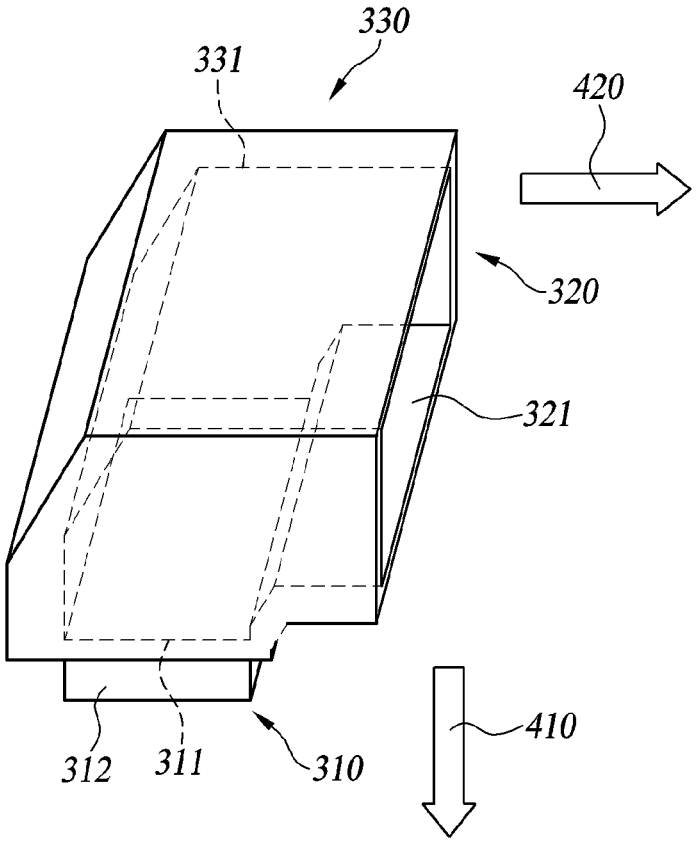
FIG. 2 illustratively shows the configuration of a connector according to one embodiment of the invention.

FIG. 2 illustratively shows the configuration of the connector 300 according to one embodiment of the invention.

Referring to FIG. 2, the connector 300 as shown in FIG. 1 according to one embodiment of the invention may comprise: a first opening part 310 formed in a direction 410 perpendicular to one side of the board 100 as shown in FIG. 1 and coupled to the one side of the board 100; a second opening part 320 formed in a direction 420 parallel to a longitudinal direction of the waveguide 200 as shown in FIG. 1 for signal transmission, wherein the waveguide 200 may be coupled to the second opening part 320; and a signal guide part 330 connecting the first opening part 310 and the second opening part 320 and including a hollow portion surrounded by a conductive layer therein.

Specifically, the first opening part 310 according to one embodiment of the invention may comprise an opening 311 formed in the direction 410 perpendicular to the one side of the board 100, and one side 312 including the opening 311 may be coupled to the board 100 such that the one side 312 faces the one side 110 (FIG. 3) of the board 100.

Figure 3:
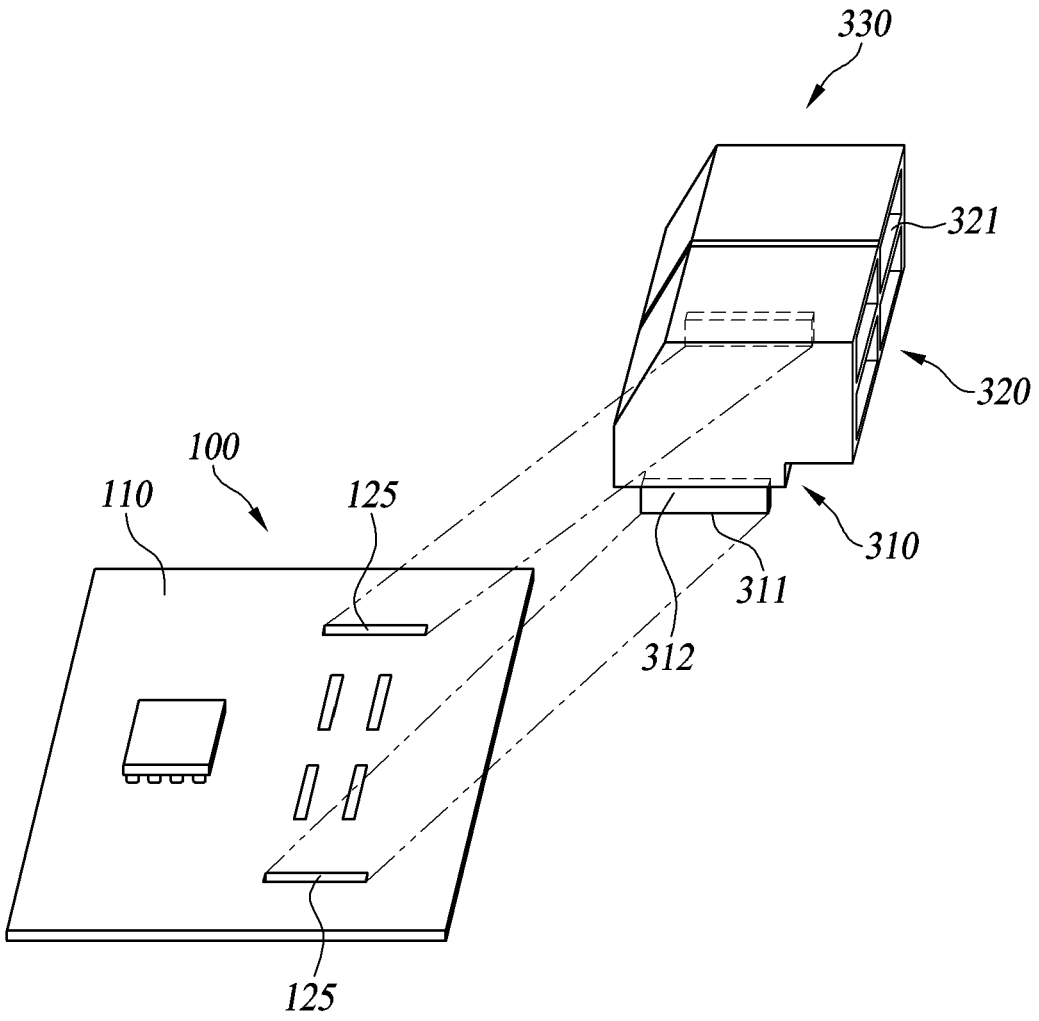
FIG. 3 illustratively shows the configuration of a means for coupling a board and a connector according to one embodiment of the invention.

For example, referring to FIG. 3, the first opening part 310 according to one embodiment of the invention may comprise a latch, and the latch may be placed into a slot 125 of the board 100 so that the one side 312 of the first opening part 310 and the one side 110 of the board 100 may be fixed facing each other. Further, according to one embodiment of the invention, soldering may be performed to reinforce the fixing (or coupling) between the board 100 and the first opening part 310.

Meanwhile, the manner of coupling the board 100 and the first opening part 310 according to one embodiment of the invention is not limited to the above-described latch coupling, and may be variously changed (e.g., to a bolt-nut coupling) as long as the objects of the invention can be achieved.

Next, the second opening part 320 according to one embodiment of the invention may comprise an opening 321 formed in the direction 420 as shown in FIG. 2 parallel to the longitudinal direction of the waveguide 200 as shown in FIG. 1, and the waveguide 200 may be coupled through the opening 321.

For example, according to one embodiment of the invention, the coupling may be made by the waveguide 200 being inserted into the opening 321 formed in the direction 420 parallel to the longitudinal direction of the waveguide 200.

Meanwhile, the direction 420 in which the second opening part 320 (specifically, the opening 321 of the second opening part 320) according to one embodiment of the invention is formed may be perpendicular to the direction 410 in which the first opening part 310 (specifically, the opening 311 of the first opening part 310) is formed, or may be parallel to the one side of the board 100.

Next, referring to FIG. 2, the signal guide part 330 according to one embodiment of the invention may comprise a hollow portion 331 penetrating the first opening part 310 and the second opening part 320, and may guide a signal transmitted through the waveguide 200 such that the signal is transmitted to the board 100 along the hollow portion 331, or guide a signal transmitted through the board 100 such that the signal is transmitted to the waveguide 200 along the hollow portion 331. Meanwhile, according to one embodiment of the invention, an insulating (or dielectric) material other than air may be included in the hollow portion 331, as necessary.

Further, according to one embodiment of the invention, the signal guide part 330 may comprise a conductive layer surrounding the hollow portion 331 to reduce signal loss that may occur as the direction in which a signal transmitted through the waveguide 200 or transmitted from the board 100 is transmitted is changed (specifically, guided through the connector 300). That is, according to one embodiment of the invention, the conductor layer may extend from the first opening part 310 (specifically, the opening 311 of the first opening part 310) to the second opening part 320 (specifically, the opening 321 of the second opening part 320) to surround the hollow portion 331, thereby preventing a signal propagated between the board 100 and the waveguide 200 from leaking outwardly.

For example, according to one embodiment of the invention, the signal guide part 330 may consist of metal, or only some of layers around the hollow portion 331 of the signal guide part 330 may be formed as conductive layers, so that the hollow portion 331 may be surrounded by the conductive layers. Meanwhile, according to one embodiment of the invention, various methods such as metal bonding, metal plating, and sputtering may be utilized to form some layers as the conductive layers as described above.

Figure 4:
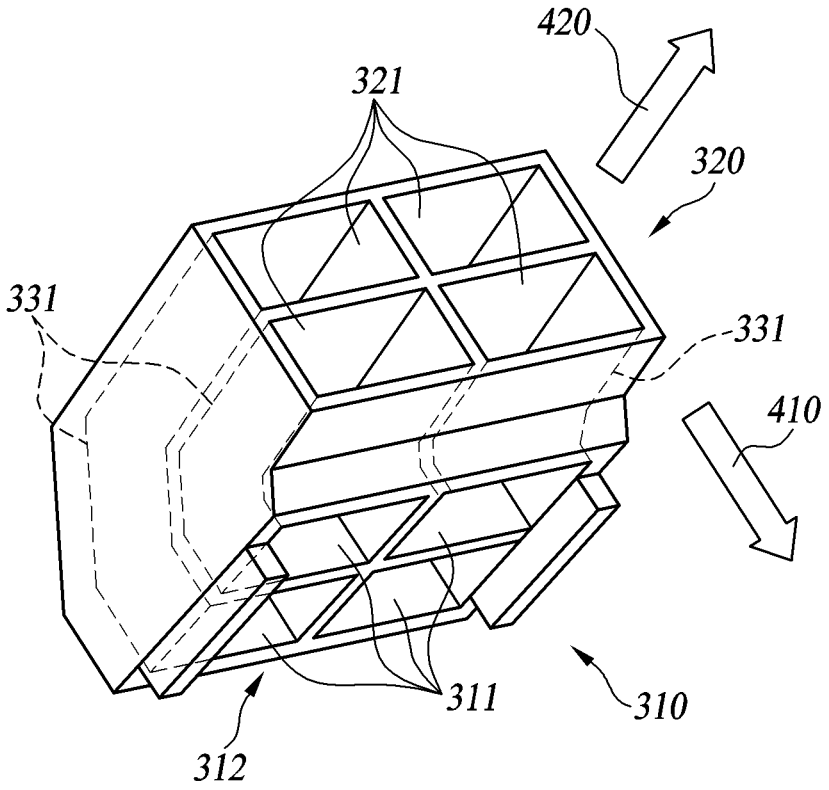
FIG. 4 illustratively shows the configuration of another connector according to one embodiment of the invention.

Meanwhile, referring to FIG. 4, when the waveguide 200 as shown in FIG. 1 is a plurality of waveguides, the signal guide part 330 as shown in FIG. 3 according to one embodiment of the invention may comprise the hollow portion 331 corresponding to each of the plurality of waveguides 200, and may guide a signal transmitted through the plurality of waveguides 200 such that the signal is transmitted to the board 100 along the hollow portion 331 corresponding to each of the plurality of waveguides 200, or guide a signal transmitted through the board 100 such that the signal is transmitted to the plurality of waveguides 200 along the hollow portion 331 corresponding to each of the plurality of waveguides 200.

Figure 5:
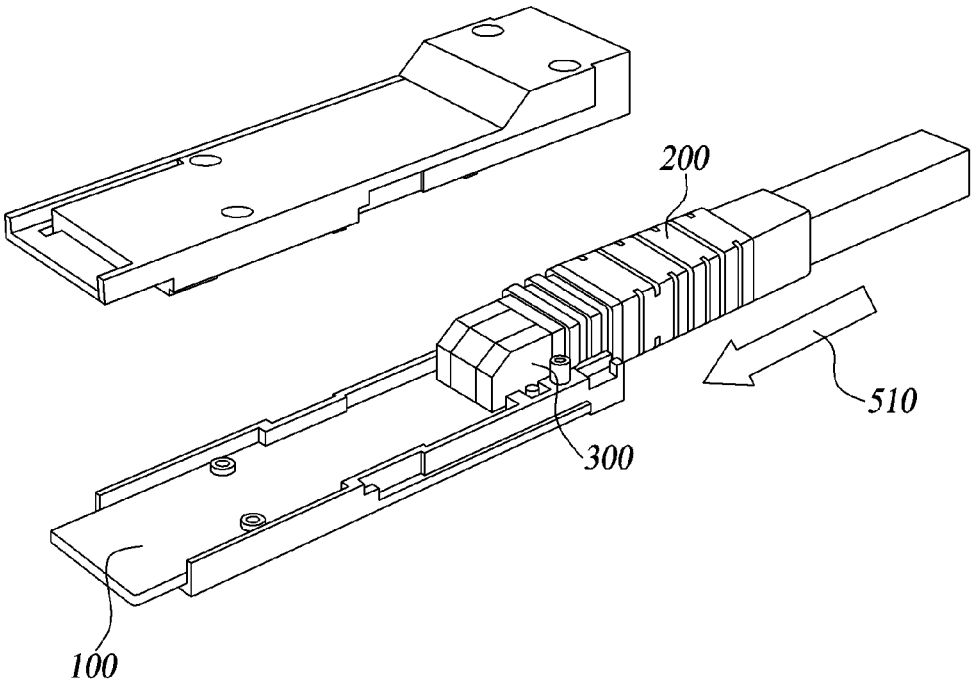
FIG. 5 illustratively shows situations in which a waveguide and a connector according to one embodiment of the invention are connected and disconnected.
Figure 6:
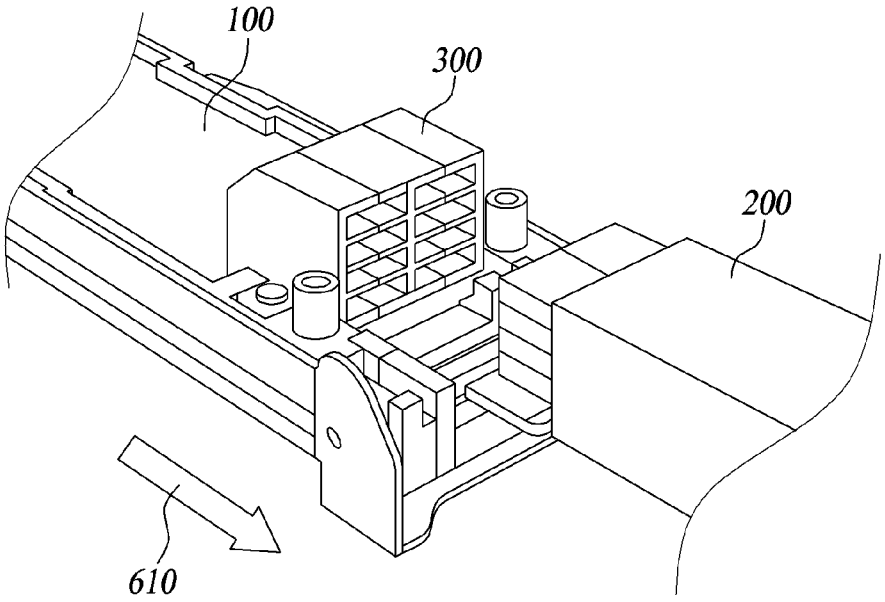
FIG. 6 illustratively shows situations in which a waveguide and a connector according to one embodiment of the invention are connected and disconnected.

FIGS. 5 and 6 illustratively show situations in which the waveguide 200 and the connector 300 according to one embodiment of the invention are connected and disconnected.

Referring to FIGS. 5 and 6, it may be assumed that eight waveguides 200 are coupled to the connector 300 according to one embodiment of the invention. (For example, the waveguides 200 are similar to conventional QSFP (Quad Small Form-factor Pluggable) modules.)

First, referring to FIG. 5, according to one embodiment of the invention, the eight waveguides 200 and the connector 300 may be coupled to each other when pressure is applied to the connector 300 (specifically, the second opening part 320 of the connector 300 as shown in FIG. 1) coupled to one side of the board 100, in a direction 510 parallel to a longitudinal direction of the waveguides 200 or parallel to the one side of the board 100.

Meanwhile, according to one embodiment of the invention, the second opening part 320 of the connector 300 may comprise eight openings in which the eight waveguides 200 may be respectively inserted, and the first opening part 310 of the connector 300 as shown in FIG. 1 may comprise eight openings that respectively correspond to the eight openings of the second opening part 320. Further, the signal guide part 330 of the connector 300 as shown in FIG. 1 according to one embodiment of the invention may comprise eight hollow portions penetrating between the first opening part 310 and the second opening part 320.

That is, in this case, a signal transmitted through the eight waveguides 200 may be guided such that the signal is transmitted to the board 100 along the hollow portion corresponding to each of the eight waveguides 200, or a signal transmitted through the board 100 may be guided such that the signal is transmitted to the eight waveguides 200 along the hollow portion corresponding to each of the eight waveguides 200.

Next, referring to FIG. 6, according to one embodiment of the invention, the eight waveguides 200 may be disconnected from the connector 300 when pressure is applied to the eight waveguides 200 coupled as above, in a direction 610 parallel to the longitudinal direction of the waveguides 200 or parallel to the one side of the board 100 (specifically, opposite to the direction 510 of FIG. 5).

It is noted that although the embodiments in which the eight waveguides 200 are coupled to the connector 300 have been mainly described above, the present invention is not necessarily limited to that number of waveguides, and the number may be variously changed to 2, 4, 6 or the like as long as the objects of the invention can be achieved.

Configuration of the Waveguide

Hereinafter, the illustrative configuration of the waveguide 200 that may be connected to the above-described connector 300 as shown in FIG. 1 according to the invention will be described.

Figure 7:
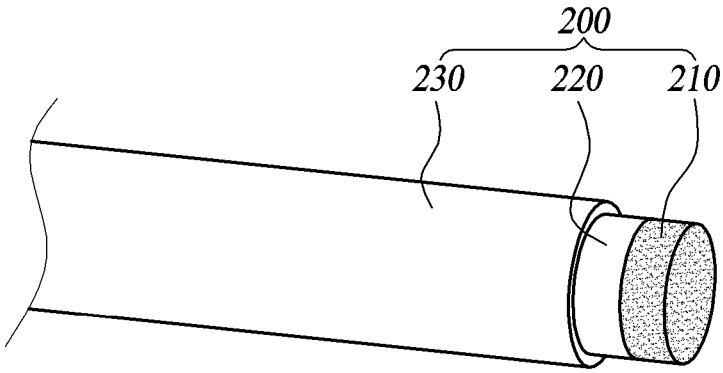
FIG. 7 illustratively shows the configuration of a waveguide according to one embodiment of the invention.

FIG. 7 illustratively shows the configuration of the waveguide 200 according to one embodiment of the invention.

Referring to FIG. 7, the waveguide 200 according to one embodiment of the invention may comprise a dielectric part 210 consisting of dielectric. Further, the waveguide 200 according to one embodiment of the invention may comprise the dielectric part 210 comprising a first and a second dielectric part having different permittivity, and a metal part 220 surrounding the dielectric part 210. For example, the first dielectric part may be in the form of a core disposed at the center of the waveguide, and the second dielectric part may be a component consisting of a material having permittivity different from that of the first dielectric part and may be formed to surround the first dielectric part, while the metal part 220 may be a component consisting of metal such as copper and may be in the form of a cladding surrounding the second dielectric part.

Meanwhile, the waveguide 200 according to one embodiment of the invention may further comprise a jacket 230 consisting of a covering material enveloping the dielectric part 210 and the metal part 220.

Referring further to FIG. 7, the dielectric part 210 may be exposed where the waveguide 200, according to one embodiment of the invention, is connected to the connector 300, without being surrounded by the metal part 220.

However, it is noted that the internal configuration or shape of the waveguide 200 according to the invention is not necessarily limited to the above description, and may be changed without limitation as long as the objects of the invention can be achieved. For example, at least one of both ends of the waveguide 200 may be tapered (i.e., linearly thinned) for impedance matching purposes.

Although the present invention has been described in terms of specific items such as detailed elements as well as the limited embodiments and the drawings, the detailed elements and the limited embodiments are only provided to help more general understanding of the invention, and the present invention is not limited to the above embodiments. It will be appreciated by those skilled in the art to which the present invention pertains that various modifications and changes may be made from the above description.

Therefore, the spirit of the present invention shall not be limited to the above-described embodiments, and the entire scope of the appended claims and their equivalents will fall within the scope and spirit of the invention.

What is claimed is:

1. A connector for connecting a waveguide and a board, comprising:

a first opening part formed in a direction perpendicular to one side of the board and coupled to the one side of the board;

a second opening part formed in a direction parallel to a longitudinal direction of a waveguide for signal transmission, wherein the waveguide is capable of being coupled to the second opening part; and a signal guide part connecting the first and second opening parts and including a hollow portion surrounded by a conductive layer therein, wherein the first opening part is coupled to the one side of the board by means of a latch or a bolt-nut coupling.

2. The connector of claim 1, wherein the signal guide part is configured to guide a signal transmitted from the waveguide such that the signal is transmitted to the board along the hollow portion, or to guide a signal transmitted from the board such that the signal is transmitted to the waveguide along the hollow portion.

3. The connector of claim 1, wherein the second opening part is formed in a direction perpendicular to the direction in which the first opening part is formed.

4. A connector for connecting a waveguide and a board, comprising:

a first opening part formed in a direction perpendicular to one side of the board and coupled to the one side of the board;

a second opening part formed in a direction parallel to a longitudinal direction of a waveguide for signal transmission, wherein the waveguide is capable of being coupled to the second opening part; and a signal guide part connecting the first and second opening parts and including a hollow portion surrounded by a conductive layer therein, wherein an insulating material other than air is included in the hollow portion.

5. The connector of claim 4, wherein the waveguide comprises a dielectric part and a metal part surrounding the dielectric part, at least a portion of the dielectric part is exposed without being surrounded by the metal part, and the second opening part is configured to be coupled with the waveguide in a manner that the exposed dielectric part is inserted into the second opening part.

6. A connector for connecting a plurality of waveguides and a board, comprising:

a first opening part formed in a direction perpendicular to one side of the board and coupled to the one side of the board;

a second opening part formed in a direction parallel to a longitudinal direction of the plurality of waveguides for signal transmission, wherein each of the plurality of waveguides is capable of being coupled to the second opening part; and a signal guide part connecting the first and second opening parts and including a plurality hollow portions surrounded by a conductive layer therein, wherein the signal guide part is configured to guide a respective signal transmitted from the plurality of waveguides such that the respective signal is transmitted to the board along each of the plurality hollow portions corresponding to each of the plurality of waveguides, or to guide a signal transmitted from the board such that the signal is transmitted to the plurality of waveguides along each of the plurality of hollow portions corresponding to each of the plurality of waveguides, and wherein the first opening part is coupled to the one side of the board by means of a latch or a bolt-nut coupling.

* * * * *